US007225676B2

(12) United States Patent
Randazzo

(10) Patent No.: US 7,225,676 B2
(45) Date of Patent: Jun. 5, 2007

(54) METHOD AND APPARATUS FOR THE DETECTION OF HIGH PRESSURE CONDITIONS IN A VACUUM SWITCHING DEVICE

(75) Inventor: Steven Jay Randazzo, San Jose, CA (US)

(73) Assignee: Jennings Technology, San Jose, CA (US)

( * ) Notice: Subject to any disclaimer, the term of this patent is extended or adjusted under 35 U.S.C. 154(b) by 105 days.

(21) Appl. No.: 10/848,874

(22) Filed: May 18, 2004

(65) Prior Publication Data

US 2005/0258342 A1 Nov. 24, 2005

(51) Int. Cl.
*H01H 33/66* (2006.01)

(52) U.S. Cl. ..... 73/700; 218/121; 218/123

(58) Field of Classification Search ..... 73/700; 218/121, 123, 140

See application file for complete search history.

(56) References Cited

U.S. PATENT DOCUMENTS

| | | | | |
|---|---|---|---|---|
| 3,983,345 | A | 9/1976 | Phillips | |
| 4,103,291 | A | 7/1978 | Howe et al. | |
| 4,163,130 | A | 7/1979 | Kubota et al. | |
| 4,270,091 | A | 5/1981 | Mann | |
| 4,295,566 | A | 10/1981 | Vincek | |
| 4,402,224 | A | 9/1983 | Fukushima | |
| 4,403,124 | A | 9/1983 | Perkins et al. | |
| 4,440,995 | A | 4/1984 | Lange et al. | |
| 4,484,818 | A | 11/1984 | Houston | |
| 4,491,704 | A | 1/1985 | Milianowicz et al. | |
| 4,513,208 | A | 4/1985 | Kamata | |
| 4,877,143 | A | 10/1989 | Travisano | |
| 4,937,698 | A | 6/1990 | Toya et al. | |
| 4,980,528 | A * | 12/1990 | Spooner | 218/26 |
| 5,286,933 | A | 2/1994 | Pham | |
| 5,289,929 | A | 3/1994 | Heilman et al. | |
| 5,551,285 | A | 9/1996 | Gannon et al. | |
| 5,747,766 | A * | 5/1998 | Waino et al. | 218/140 |
| 6,310,310 | B1 * | 10/2001 | Wristen | 218/121 |
| 6,346,683 | B1 * | 2/2002 | Okutomi et al. | 218/123 |
| 6,659,037 | B2 | 12/2003 | Hagopian | |
| 7,037,081 | B2 * | 5/2006 | Allington et al. | 417/18 |

FOREIGN PATENT DOCUMENTS

| | | |
|---|---|---|
| EP | 0365005 | 10/1989 |

* cited by examiner

*Primary Examiner*—Andre J. Allen
(74) *Attorney, Agent, or Firm*—Lorimer Labs; D'Arcy H. Lorimer

(57) ABSTRACT

A method for detecting a high pressure condition within an interrupter includes measuring the intensity of light emitted from an arc created by contacts within the interrupter, comparing the measured intensity with a predetermined value, and providing an indication when the measured intensity exceeds the predetermined value.

4 Claims, 11 Drawing Sheets

METHOD AND APPARATUS FOR THE DETECTION OF HIGH PRESSURE CONDITIONS IN A VACUUM SWITCHING DEVICE

BACKGROUND OF THE INVENTION

1. Field of the Invention

This invention relates to detection of failure conditions in high power electrical switching devices, particularly to the detection of high pressure conditions in a vacuum interrupter.

2. Description of the Related Art

The reliability of the North American power grid has come under critical scrutiny in the past few years, particularly as demand for electrical power by consumers and industry has increased. Failure of a single component in the grid can cause catastrophic power outages that cascade throughout the system. One of the essential components utilized in the power grid are the mechanical switches used to turn on and off the flow of high current, high voltage AC power. Although semiconductor devices are making some progress in this application, the combination of very high voltages and currents still make the mechanical switch the preferred device for this application.

There are basically two configurations for these high power mechanical switches; oil filled and vacuum. The oil filled switch utilizes contacts immersed in a hydrocarbon based fluid having a high dielectric strength. This high dielectric strength is required to withstand the arcing potential at the switching contacts as they open to interrupt the circuit. Due to the high voltage service conditions, periodic replacement of the oil is required to avoid explosive gas formation that occurs during breakdown of the oil. The periodic service requires that the circuits be shut down, which can be inconvenient and expensive. The hydrocarbon oils can be toxic and can create serious environmental hazards if they are spilled into the environment. The other configuration utilizes a vacuum environment around the switching contacts. Arcing and damage to the switching contacts can be avoided if the pressure surrounding the switching contacts is low enough. Loss of vacuum in this type of interrupter will create serious arcing between the contacts as they switch the load, destroying the switch. In some applications, the vacuum interrupters are stationed on standby for long periods of time. A loss of vacuum may not be detected until they are placed into service, which results in immediate failure of the switch at a time when its most needed. It therefore would be of interest to know in advance if the vacuum within the interrupter is degrading, before a switch failure due to contact arcing occurs. Currently, these devices are packaged in a manner that makes inspection difficult and expensive. Inspection may require that power be removed from the circuit connected to the device, which may not be possible. It would be desirable to remotely measure the status of the pressure within the switch, so that no direct inspection is required. It would also be desirable to periodically monitor the pressure within the switch while the switch is in service and at operating potential.

It might seem that the simple measurement of pressure within the vacuum envelope of these interrupter devices would be adequately covered by devices of the prior art, but in reality, this is not the case. A main factor is that the switch is used for switching high AC voltages, with potentials between 7 and 100 kilovolts above ground. This makes application of prior art pressure measuring devices very difficult and expensive. Due to cost and safety constraints, complex high voltage isolation techniques of the prior art are not suitable. What is needed is a method and apparatus to safely and inexpensively measure a high pressure condition in a high voltage interrupter, preferably remote from the switch, and preferably while the switch is at operating potential.

FIG. 1 is a cross sectional view 100 of a first example of a vacuum interrupter of the prior art. This particular unit is manufactured by Jennings Technology of San Jose, Calif. Contacts 102 and 104 are responsible for the switching function. A vacuum, usually below $10^{-4}$ torr, is present near the contacts in region 114 and within the envelope enclosed by cap 108, cap 110, bellows 112, and insulator sleeve 106. Bellows 112 allows movement of contact 104 relative to stationary contact 102, to make or break the electrical connection.

FIG. 2 is a cross sectional view 200 of a second example of a vacuum interrupter of the prior art. This unit is also manufactured by Jennings Technology of San Jose, Calif. In this embodiment of the prior art, contacts 202 and 204 perform the switching function. A vacuum, usually below $10^{-4}$ torr, is present near the contacts in region 214 and within the envelope enclosed by cap 208, cap 210, bellows 212, and insulator sleeve 206. Bellows 112 allows movement of contact 202 relative to stationary contact 204, to make or break the electrical connection.

SUMMARY OF THE INVENTION

It is an object of the present invention to provide a method for detecting a high pressure condition within an interrupter, including measuring an intensity of at least a portion of light emitted from an arc created by contacts within the interrupter, comparing the measured intensity with a predetermined value, and providing a first indication when the measured intensity exceeds the predetermined value.

It is another object of the present invention to provide a method for detecting a high pressure condition within an interrupter, including transmitting a beam of light through a window placed within an exterior wall of the interrupter, reflecting the beam of light off a reflective surface, the reflective surface residing within the interior volume of the interrupter, measuring an intensity of at least a portion of the reflected beam of light, comparing the measured intensity with a predetermined value, and providing an indication when the measured intensity is less than the predetermined value.

It is another object of the present invention to provide a method for detecting a high pressure condition within an interrupter, including placing a diaphragm within an outer wall of the interrupter, wherein the diaphragm is in a collapsed position for internal pressures below a first predetermined value, and the diaphragm is in an expanded condition for internal pressures above a second predetermined value. The method further includes directing a beam of light at an outer surface of the diaphragm, detecting a reflected beam of light from the outer surface when the diaphragm is in the collapsed position, producing a non-detectable reflected beam of light when the outer surface of the diaphragm is in the expanded position, and producing a high pressure indication when the beam of light is no longer detected.

It is another object of the present invention to provide a method for detecting a high pressure condition within an interrupter, including placing a diaphragm within an outer wall of the interrupter, wherein the diaphragm is in a collapsed position for internal pressures below a first predetermined value, and the diaphragm is in an expanded position for internal pressures above a second predetermined value. The method further includes directing a beam of light at an outer surface of the diaphragm, detecting a reflected beam of light from the outer surface when the diaphragm is in the expanded position, producing a non-detectable reflected beam of light when the outer surface of the diaphragm is in the collapsed position and, producing a high pressure indication when the beam of light is detected.

It is another object of the present invention to provide method for detecting a high pressure condition within an interrupter, including placing a pressure transducer within an enclosed volume of the interrupter, placing a window within an external wall of the interrupter, converting pressure measurements made by the pressure transducer to an optical signal, and directing the optical signal through the window.

It is another object of the present invention to provide method for detecting a high pressure condition within an interrupter, including placing a pressure transducer within an enclosed volume of the interrupter, converting pressure measurements made by the pressure transducer to an RF signal, and transmitting the RF signal to a receiver located outside the interrupter.

It is another object of the present invention to provide an apparatus for detecting high pressure within an interrupter, including a collapsible device, enclosed within an interrupter, having a first surface and a second surface, the first surface fixed relative to the interrupter; a shaft, having a first end and a second end, the first end attached to the second surface of the collapsible device; and, a means for detecting a position of the second end of the shaft.

It is another object of the present invention to provide an apparatus for detecting high pressure within an interrupter including a cylinder having a piston, a first volume, and a second volume, the piston dividing the first volume from the second volume, the first volume fluidically coupled to an interior volume of the interrupter; a shaft, attached to the piston and extending out of the cylinder; and, a means for detecting a position of the shaft.

BRIEF DESCRIPTION OF THE DRAWINGS

The present invention will be better understood when consideration is given to the following detailed description thereof. Such description makes reference to the annexed drawings, wherein.

DETAILED DESCRIPTION OF THE PREFERRED EMBODIMENTS

Figure 1:
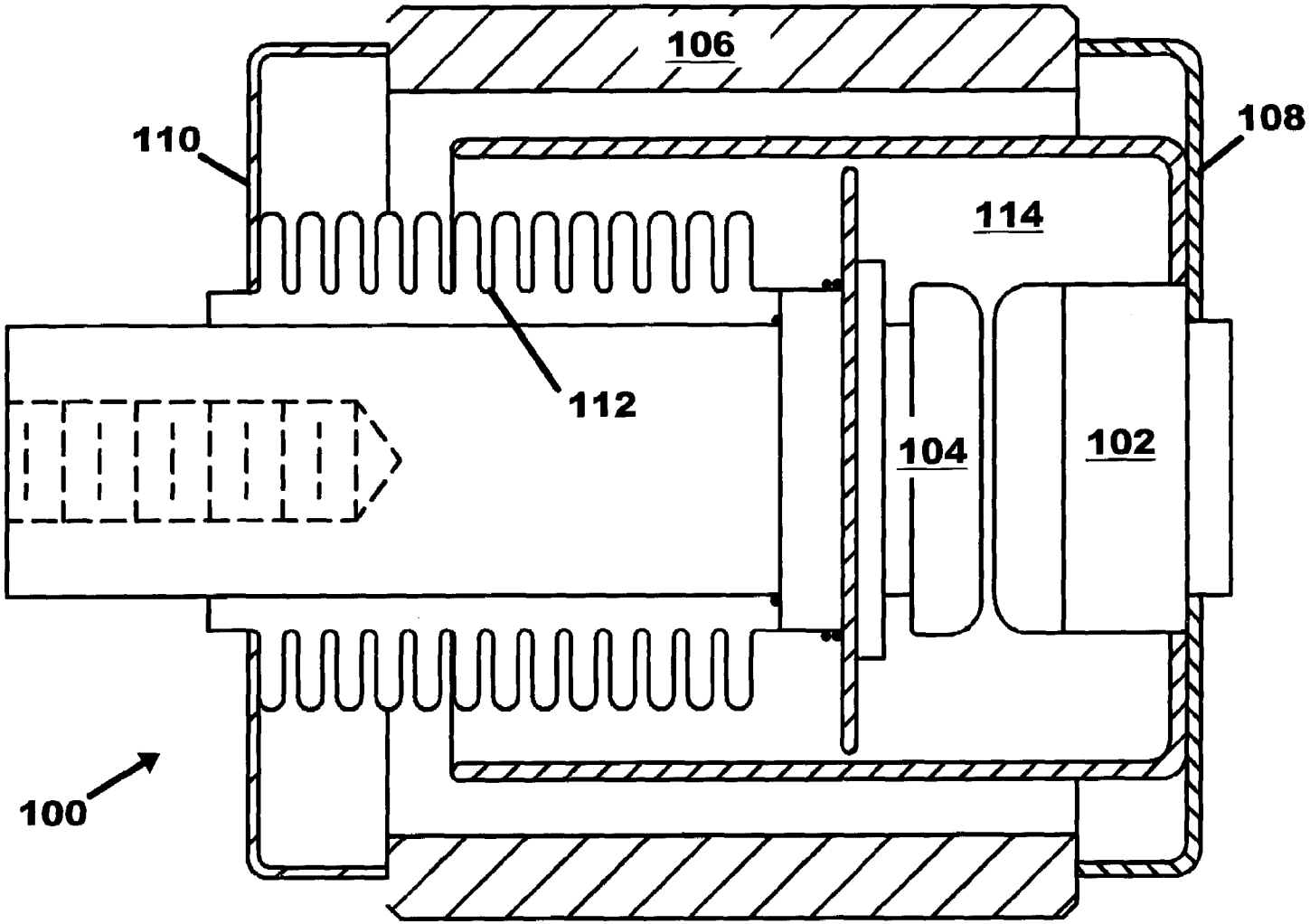
Fig. 1 Prior Art
FIG. 1 is a cross sectional view of a first example of a vacuum interrupter of the prior art.
Figure 2:
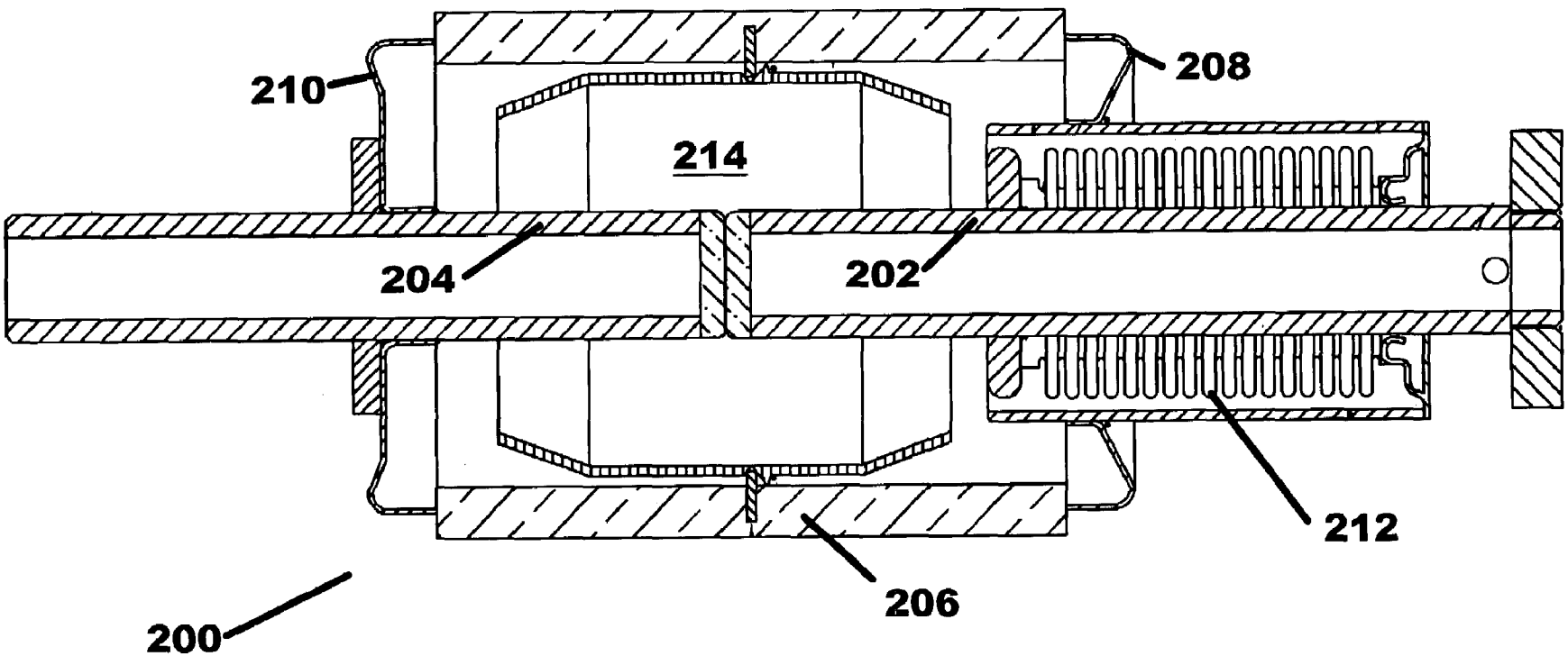
Fig. 2 Prior Art
FIG. 2 is a cross sectional view of a second example of a vacuum interrupter of the prior art.

The present invention is directed toward providing methods and apparatus for the measurement of pressure within a high voltage, vacuum interrupter. As an example, various embodiments described subsequently are employed with or within the interrupter shown in FIG. 1. This by no means implies that the inventive embodiments are limited in application to this interrupter configuration only, as the illustrated embodiments of the present invention are equally applicable to the device shown in FIG. 2 or any similar device.

Figure 3:
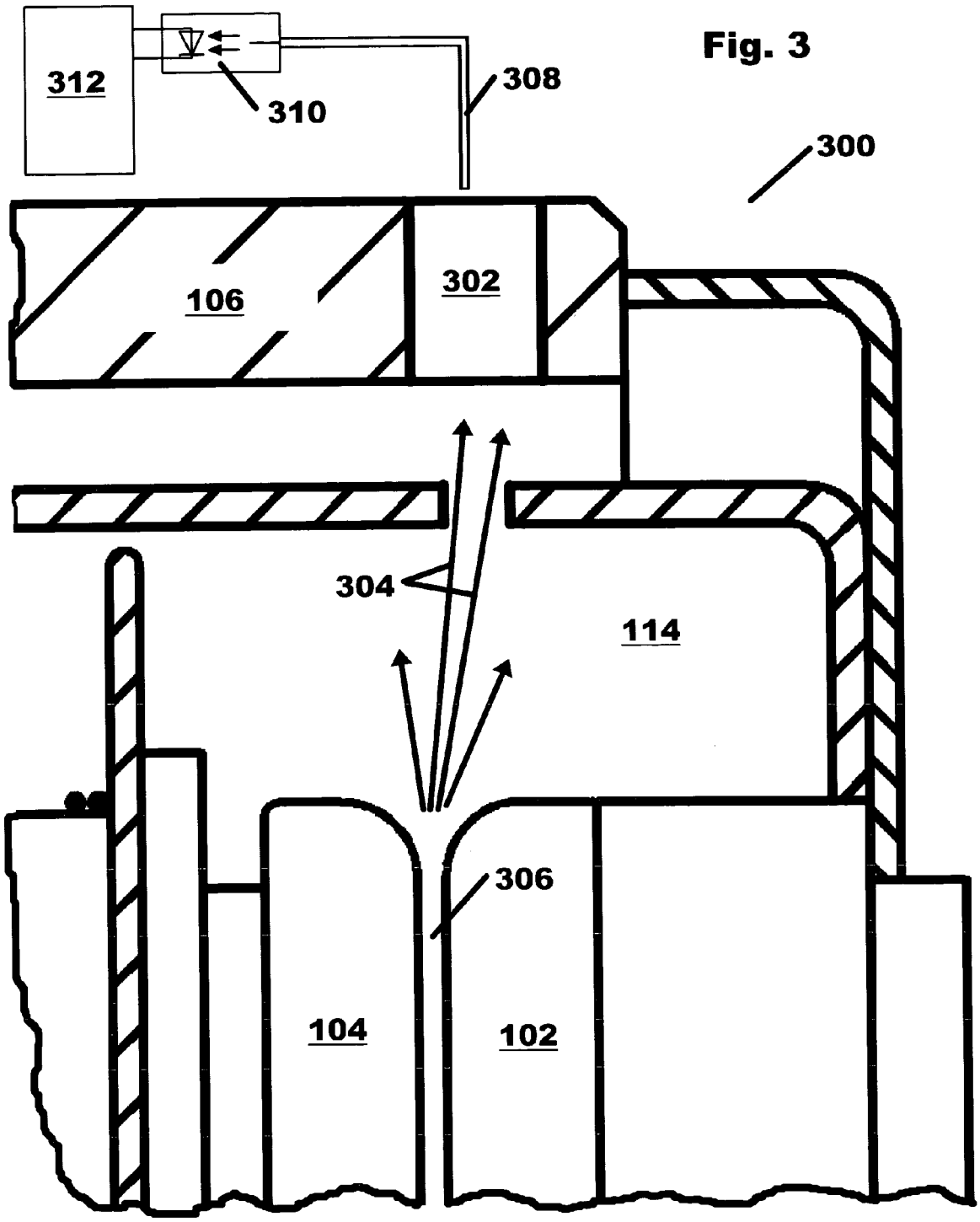
FIG. 3 is a partial cross sectional view of a device for detecting arcing contacts according to an embodiment of the present invention.

FIG. 3 is a partial cross sectional view 300 of a device for detecting arcing contacts according to an embodiment of the present invention. As the pressure in region 114 rises, arcing between contacts 104 and 102 will occur, due to the ionization of the gasses creating the increased pressure. An electrically isolated photo detector 310 is employed to observe the emitted light 304 generated in gap 306 as contacts 104 and 102 separate. Photo detector 310 may be a solid state photo diode or photo transistor type detector, or may be a photo-multiplier tube type detector. Due to cost considerations, a solid state device is preferred. The photo detector 310 is coupled to control and interface circuitry 312, which contains the necessary components (including computer processors, memory, analog amplifiers, analog to digital converters, or other required circuitry) needed to convert the signals from photo detector 310 to useful information. Photo detector 310 is optically coupled to a transparent window 302 by means of a fiber optic cable 308. Cable 308 provides the required physical and electrical isolation from the high operating voltage of the interrupter. Generally, cable 308 is comprised of an optically transparent glass, plastic or ceramic material, and is non-conductive. Window 302 is mounted in the enclosure for the interrupter, preferably in the insulator sleeve 106. Window 302 may also be mounted in the caps (for example 108) if convenient or required. Window 302 is made from an optically transparent material, including, but not limited to glass, quartz, plastics, or ceramics. Although not illustrated, it may be desirable to couple multiple cables 308 into a single photo detector 310 to monitor, for example, the status of any of three interrupters in a three phase contactor. Likewise, it may also be desirable to couple three photo detectors 310, each having a separate cable 308, into a single control unit 312. One advantage of the present embodiment, is that both the control unit 312 and/or photo detector 310 may be remotely located from the interrupter. This allows convenient monitoring of the interrupter without having to remove power from the circuit. It should be noted that elements 308, 310, and 312 are not to scale relative to the other elements in the figure.

Although the measurement of light 304 produced by the arcing of contacts 102, 104 is an indirect measurement of pressure in region 114, it is nonetheless a direct observation of the mechanism that produces failure within the interrupter. At sufficiently low pressure, no significant contact arcing will be observed because the background partial pressure will not support ionization of the residual gas. As the pressure rises, light generation from arcing will increase. Photo detector 310 may observe the intensity, frequency (color), and/or duration of the light emitted from the arcing contacts. Correlation between data generated by contact arcing under known pressure conditions can be used to develop a "trigger level" or alarm condition. Observed data generated by photo detector 310 may be compared to reference data stored in controller 312 to generate the alarm condition. Each of the characteristics of light intensity, light color, waveform shape, and duration may be used, alone or in combination, to indicate a fault condition. Alternatively, data generated from first principles of plasma physics may also be used as reference data.

Figure 4:
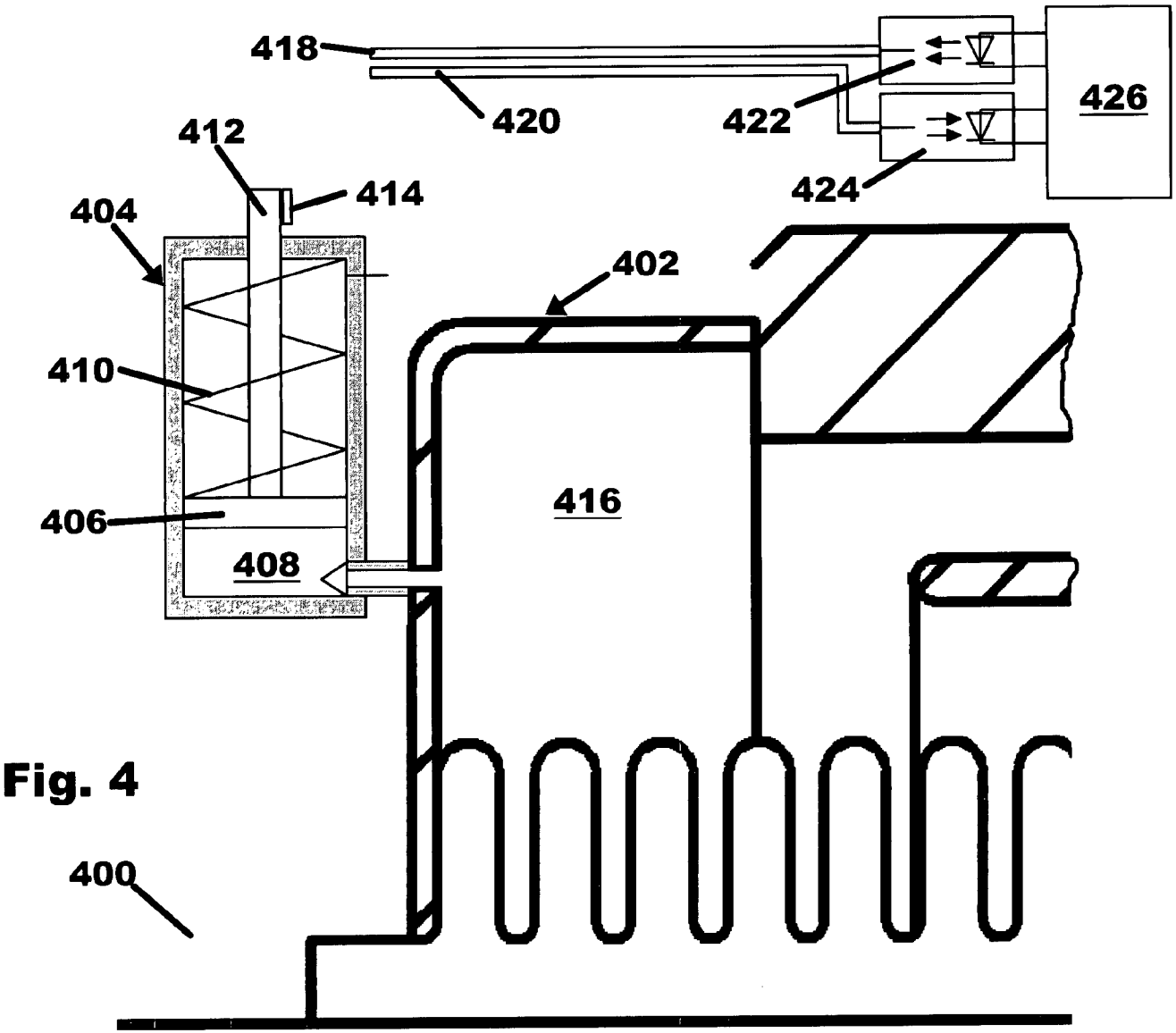
FIG. 4 is a partial cross sectional view of a cylinder actuated optical pressure switch in the low pressure state, according to an embodiment of the present invention.
Figure 5:
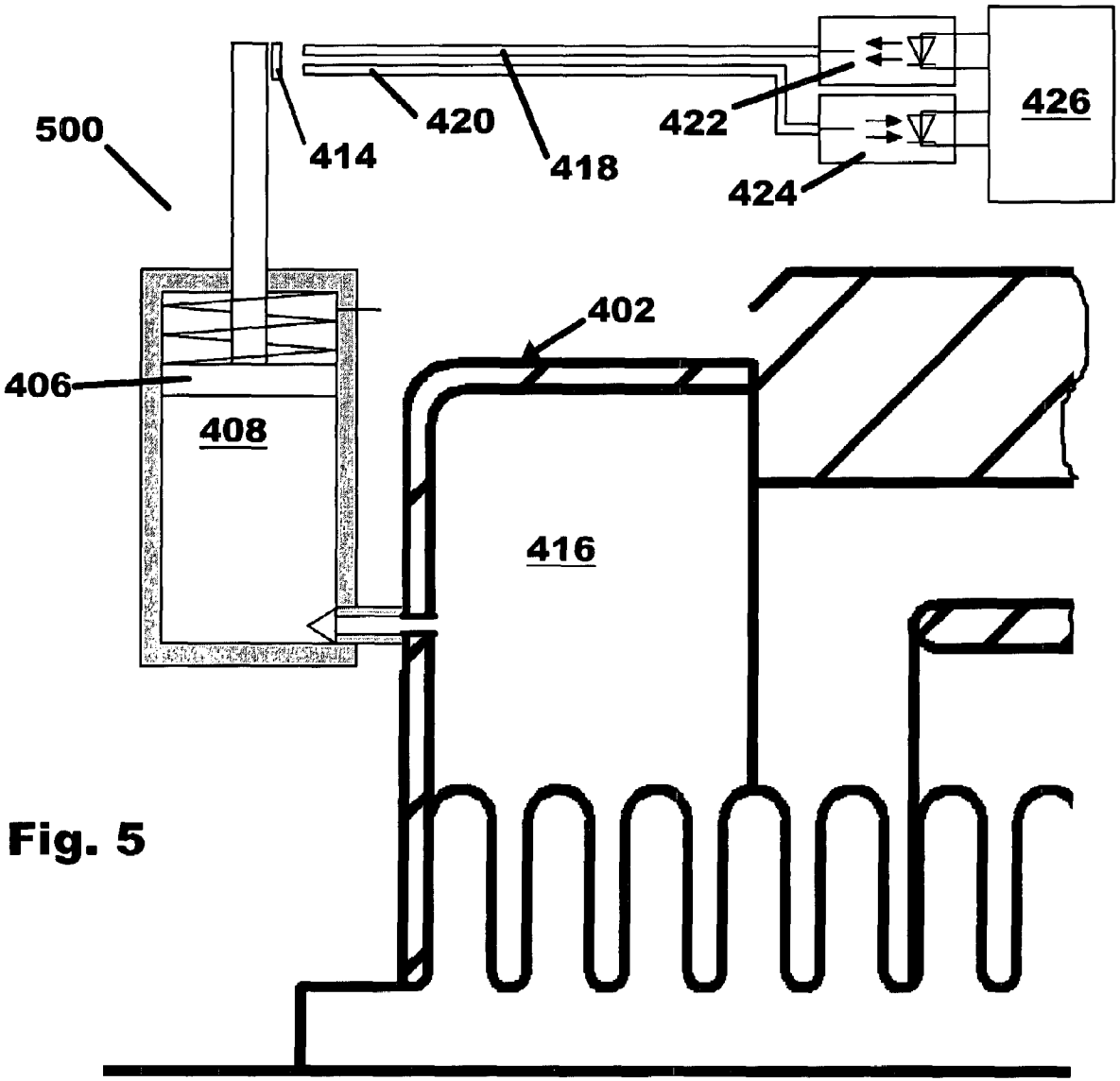
FIG. 5 is a partial cross sectional view of a cylinder actuated optical pressure switch in the high pressure state, according to an embodiment of the present invention.

FIG. 4 is a partial cross sectional view 400 of a cylinder actuated optical pressure switch 404 in the low pressure state, according to an embodiment of the present invention. FIG. 5 is a partial cross sectional view 500 of a cylinder actuated optical pressure switch 404 in the high pressure state, according to an embodiment of the present invention. In these embodiments, a pressure sensing cylinder device 404 comprises a piston 406 coupled to spring 410. Chamber 408 is fluidically coupled to the interior of interrupter 402 for sensing the pressure in region 416. A shaft 412 is attached to piston 406. Attached to shaft 412 is a reflective device 414, which may any surface suitable for returning at least a portion of the light beam emitted from optic cable 418 to optic cable 420. At low pressure, shaft 412 is retracted within cylinder 404, tensioning spring 410, as is shown in FIG. 4. Fiber optic cables 418 and 420, in concert with photo emitter 422, photo detector 424, and control unit 426, detect the position of shaft 412. At high pressure, spring 410 extends shaft 412 to a position where reflective device 414 intercepts a light beam originating from fiber optic cable 418 (via photo emitter 422), sending a reflected beam back to photo detector 424 via cable 420. An alarm condition is generated when photo detector 424 receives a signal, indicating a high pressure condition in interrupter 402. The pressure at which shaft 412 is extended to intercept the light beam is determined by the cross sectional area of piston 406 relative to the spring constant of spring 410. A stiffer spring will create an alarm condition at a lower pressure. Fiber optic cables 418 and 420 provide the necessary electrical isolation for the circuitry in devices 422–426. While the previous embodiments have shown the fiber optic cables transmitting and detecting a reflected beam, it should be evident that a similar arrangement can be utilized whereby the ends of each optical cable 418 and 420 oppose each other. In this case, the end of shaft 412 is inserted between the two cables, blocking the beam, when in the extended position. An alarm condition is generated when the beam is blocked.

Figure 6:
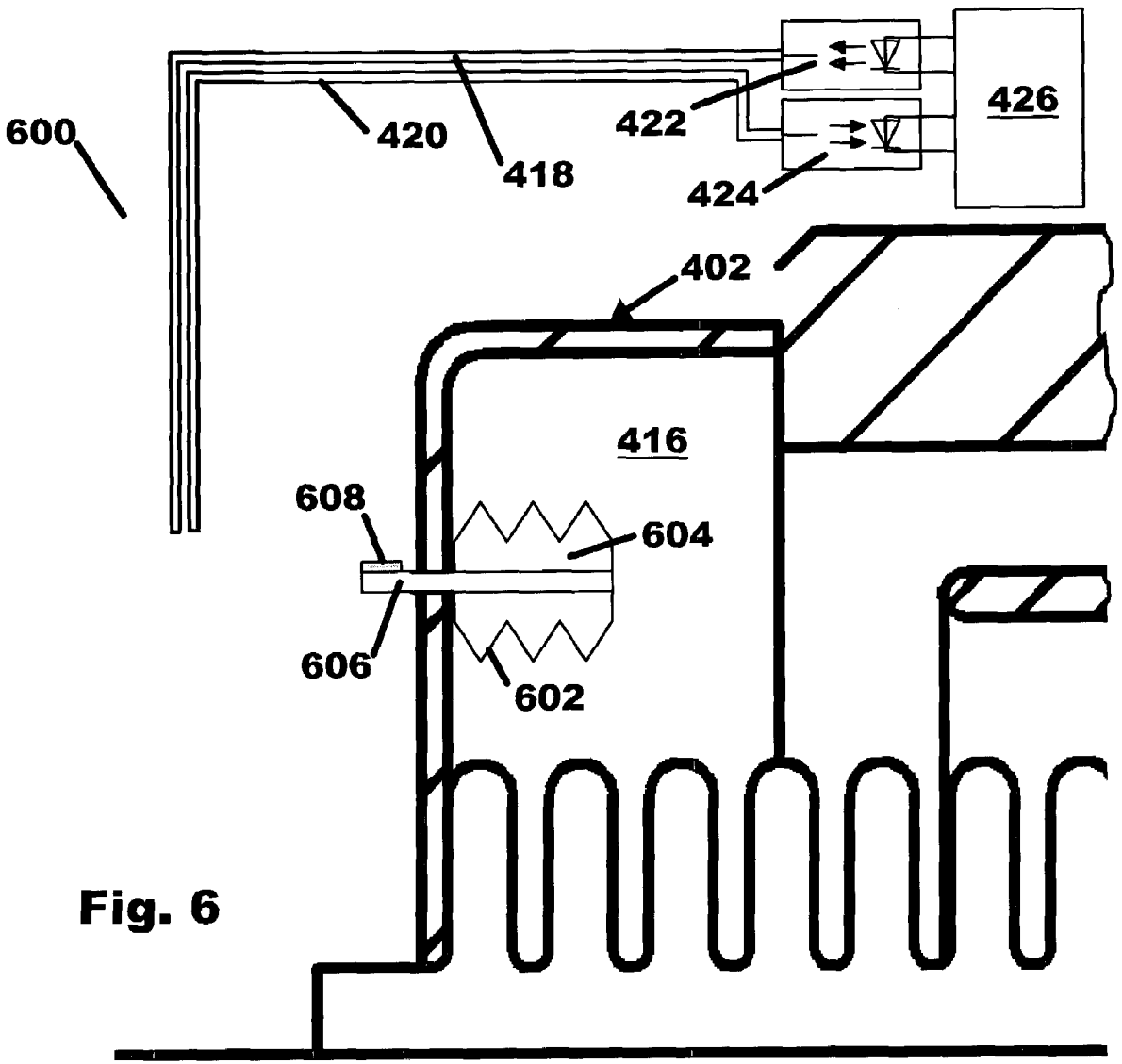
FIG. 6 is a partial cross sectional view of a bellows actuated optical pressure switch in the low pressure state, according to an embodiment of the present invention.
Figure 7:
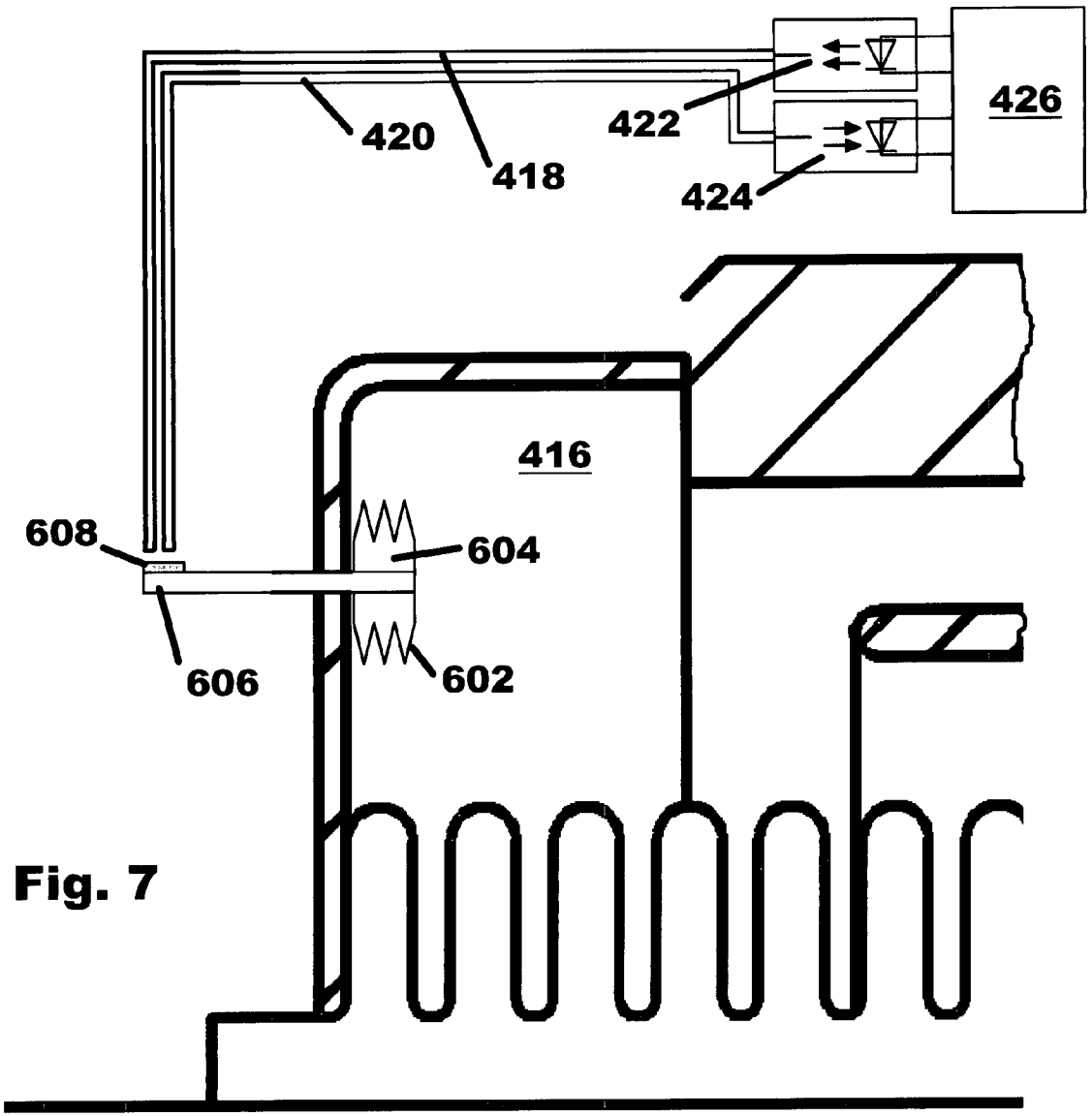
FIG. 7 is a partial cross sectional view of a bellows actuated optical pressure switch in the high pressure state, according to an embodiment of the present invention.

FIG. 6 is a partial cross sectional view 600 of a bellows actuated optical pressure switch in the low pressure state, according to an embodiment of the present invention. FIG. 7 is a partial cross sectional view of a bellows actuated optical pressure switch in the high pressure state, according to an embodiment of the present invention. Bellows 602 is mounted within interrupter 402, and is sealed against the inside wall of the interrupter such that a vacuum seal for the interior of the interrupter 402 is maintained. The inside volume 604 of the bellows is in fluid communication with the atmospheric pressure outside the interrupter. This can be accomplished by providing a large clearance around shaft 606 or an additional passage from the interior of the bellows 602 through the exterior wall of the interrupter (not shown). Bellows 602 is fabricated in such a manner as to be in the collapsed position shown in FIG. 7 when the pressure inside the bellows is equal to the pressure outside the bellows. When a vacuum is drawn outside the bellows, the bellows is extended toward the interior of region 416 of interrupter 420. At the alarm (high) pressure condition shown in FIG. 7, shaft 606 is extended, placing reflective device 608 in a position to intercept a light beam from cable 418, and reflect a least a portion of the beam back through cable 420 to detector 424. The "stiffness" of the bellows relative to its diameter, determine the alarm pressure level. A stiffer bellows material will result in a lower alarm pressure level. Fiber optic cables 418 and 420 provide the necessary electrical isolation for the circuitry in devices 422–426. While the previous embodiments have shown the fiber optic cables transmitting and detecting a reflected beam, it should be evident that a similar arrangement can be utilized whereby the ends of each optical cable 418 and 420 oppose each other. In this case, the end of shaft 606 is inserted between the two cables, blocking the beam, when in the extended position. An alarm condition is generated when the beam is blocked.

Figure 8:
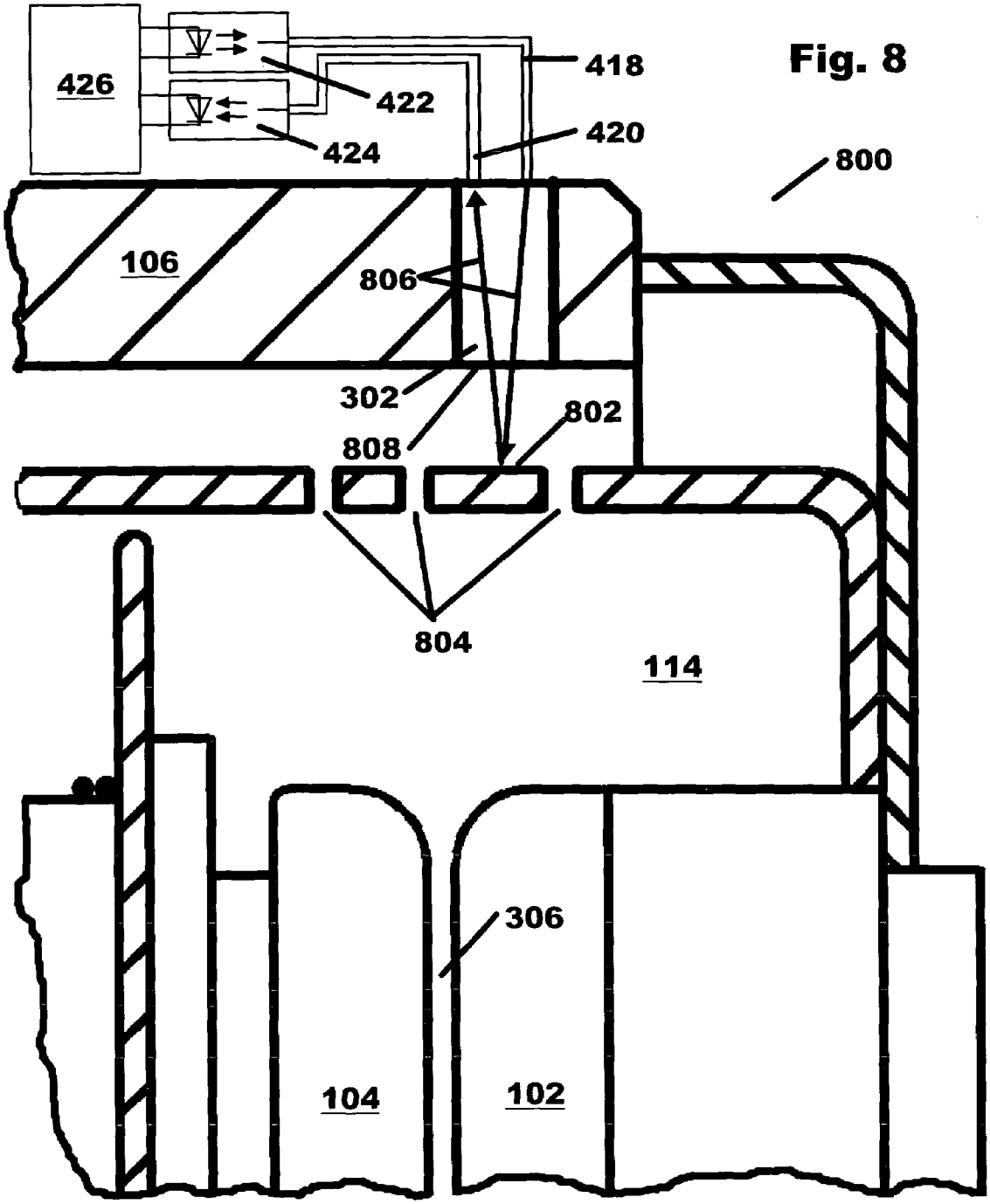
FIG. 8 is a partial cross sectional view of an optical device for detecting sputtered debris from the electrical contacts, according to an embodiment of the present invention.

FIG. 8 is a partial cross sectional view 800 of an optical device for detecting sputtered debris from the electrical contacts, according to an embodiment of the present invention. As the pressure increases inside the interrupter, arcing will occur in gap 306 between contacts 102 and 104. The arcing will "sputter" material from the contact surfaces, depositing this material on various interior surfaces. In particular, sputter debris will be deposited on surface 802, and on window 302 interior surface 808. A light beam emitted from optic cable 418 is transmitted through window 302 to reflective surface 802. Reflective surface 802 returns a portion of the beam to optic cable 420. The amount of sputtered debris on window surface 808 will determine the degree of attenuation of the light beam 806. If the beam is attenuated below a certain amount, an alarm is generated by control unit 426. Additionally, sputter debris may also cloud reflective surface 802, resulting in further beam attenuation. Ports 804 are placed in the vicinity of window 302, to aid in transporting any sputtered material to the window surface. This embodiment has the capability of providing a continuous monitoring function for detecting slow degradation of the vacuum inside the interrupter. Beam intensity can be continuously monitored and reported via controller 426, in order to schedule preventative maintenance as vacuum conditions inside the interrupter worsen.

Figure 9:
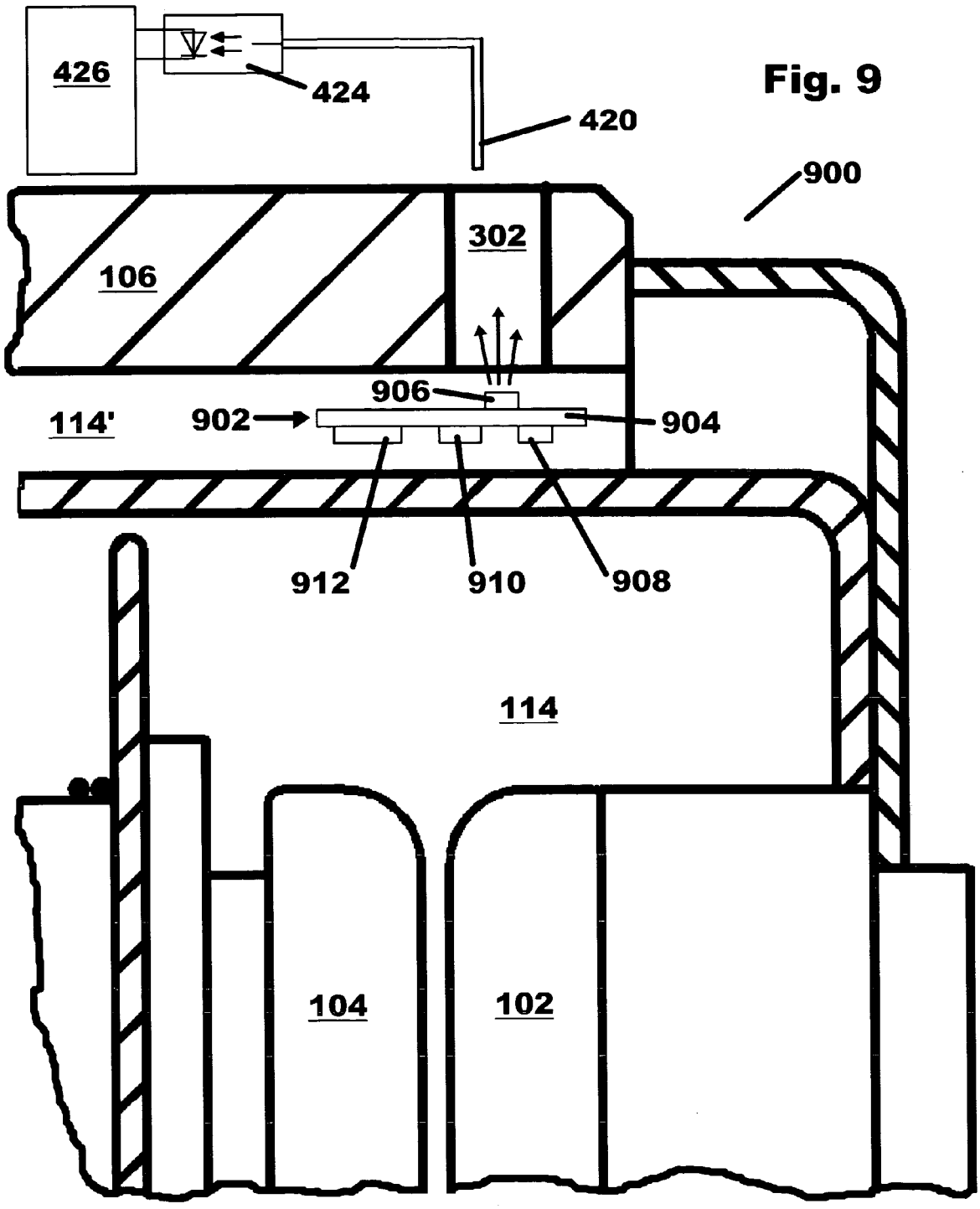
FIG. 9 is a partial cross sectional view of a self powered, optical transmission microcircuit, according to an embodiment of the present invention.

FIG. 9 is a partial cross sectional view 900 of a self powered, optical transmission microcircuit 902, according to an embodiment of the present invention. Microcircuit 902 contains a substrate 904, a photo transmission device 906, a pressure measurement component 908, amplifier and logic circuitry 910, and an inductive power supply 912. Microcircuit 902 can be a monolithic silicon integrated circuit; a hybrid integrated circuit having a ceramic substrate and a plurality of silicon integrated circuits, discrete components, and interconnects thereon; or a printed circuit board based device. The pressure within the interrupter in regions 114 and 114' are measured by a monolithic pressure transducer 908, interconnected to the circuitry on substrate 904. Amplifier and logic circuitry 910 convert signal information from the pressure transducer 908 for transmission by optical emitter device 906. The optical transmission from device 906 is delivered through window 302 to control unit 426 via optical cable 420, situated outside the interrupter. The optical transmission can be either analog or digital, preferably digital. Microcircuit 902 can deliver continuous pressure information, high pressure alarm information, or both. The inductive power supply 912 obtains its power from the oscillating magnetic fields within the interrupter. This is accomplished by placing a conductor loop (not shown) on substrate 904, then rectifying and filtering the induced AC voltage obtained from the conductor loop. Photo transmission device 906 can be a light emitting diode or laser diode, as is known to those skilled in the art. Construction of the components on substrate 904 can be monolithic or hybrid in nature. Since none of the circuitry in device 902 is referenced to ground, high voltage isolation is not required. High voltage isolation for devices 424, 426 is provided by optical cable 420, as described in previous embodiments of the present invention.

Figure 10:
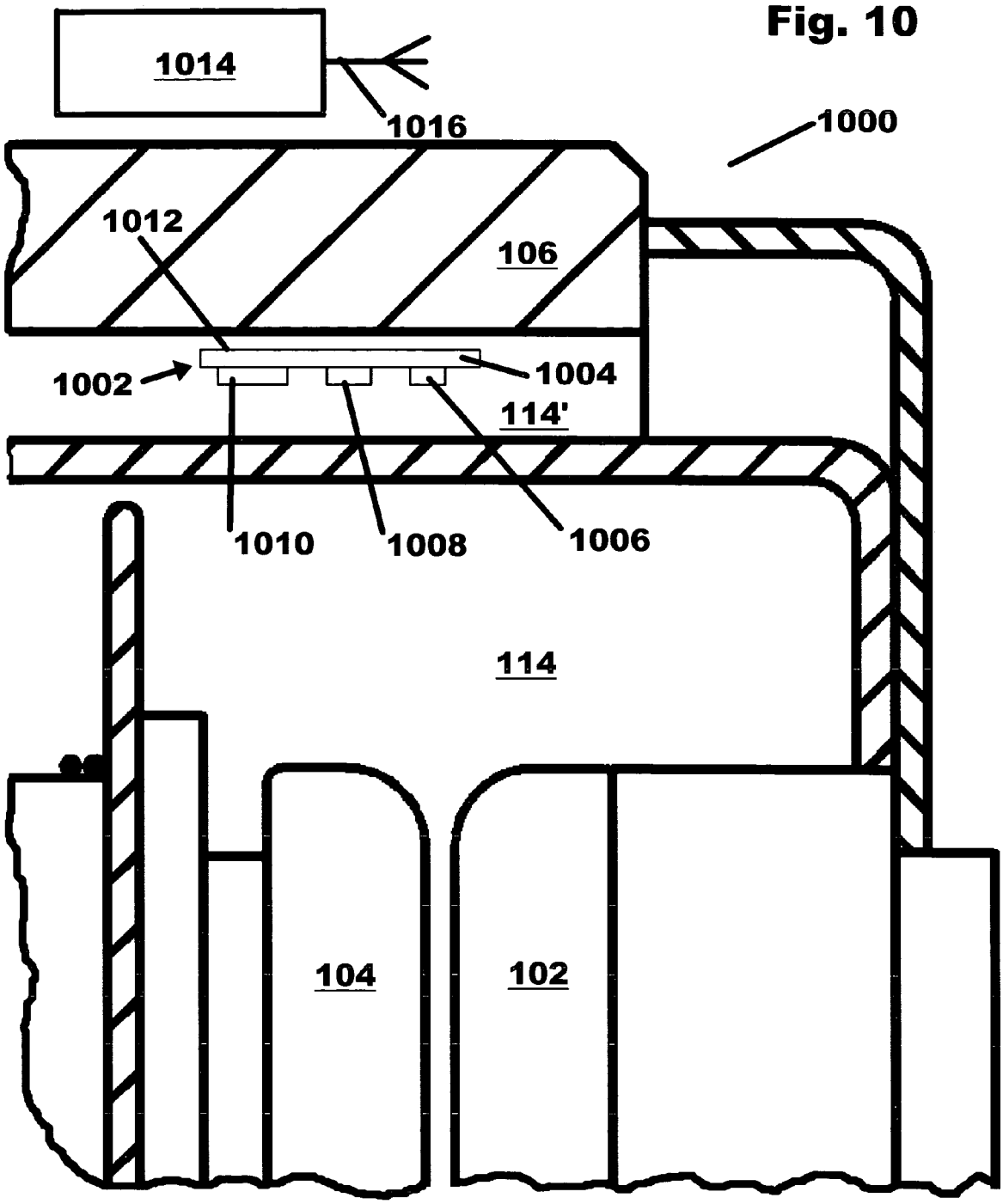
FIG. 10 is a partial cross sectional view of a self powered, RF transmission microcircuit, according to an embodiment of the present invention.

FIG. 10 is a partial cross sectional view 1000 of a self powered, RF transmission microcircuit 1002, according to an embodiment of the present invention. Microcircuit 1002 contains a substrate 1004; a pressure measurement component 1006; amplifier, logic, and RF transmission circuitry 1008; and an inductive power supply 1010. Microcircuit 1002 can be a monolithic silicon integrated circuit; a hybrid integrated circuit having a ceramic substrate and a plurality of silicon integrated circuits, discrete components, and interconnects thereon; or a printed circuit board based device. The pressure within the interrupter in regions 114 and 114' are measured by a monolithic pressure transducer 1006, interconnected to the circuitry on substrate 1004. Amplifier and logic circuitry convert signal information from the pressure transducer 1006 for transmission by an RF transmitter integrated within circuitry 1008. The RF transmission from device 906 is delivered through insulator 106 to receiver unit 1014, situated outside the interrupter. Various protocols and methods are suitable for RF transmission from integrated circuitry, as are well known to those skilled in the art. For purposes of this disclosure, RF transmission includes microwave and millimeter wave transmission. Receiver unit 1014 may be located at any convenient distance from the interrupter, within range of the transmitter contained within microcircuit 1002. Receiver unit may set up to monitor the transmissions from one or a plurality of microcircuits resident in multiple interrupter devices. Unit 1014 contains the necessary processors, memory, analog circuitry, an interface circuitry to monitor transmissions and issues alarms and other information as required. The inductive power supply 1010 obtains its power from the oscillating magnetic fields within the interrupter. This is accomplished by placing a conductor loop (not shown) on substrate 1004, then rectifying and filtering the induced AC voltage obtained from the conductor loop.

Figure 11:
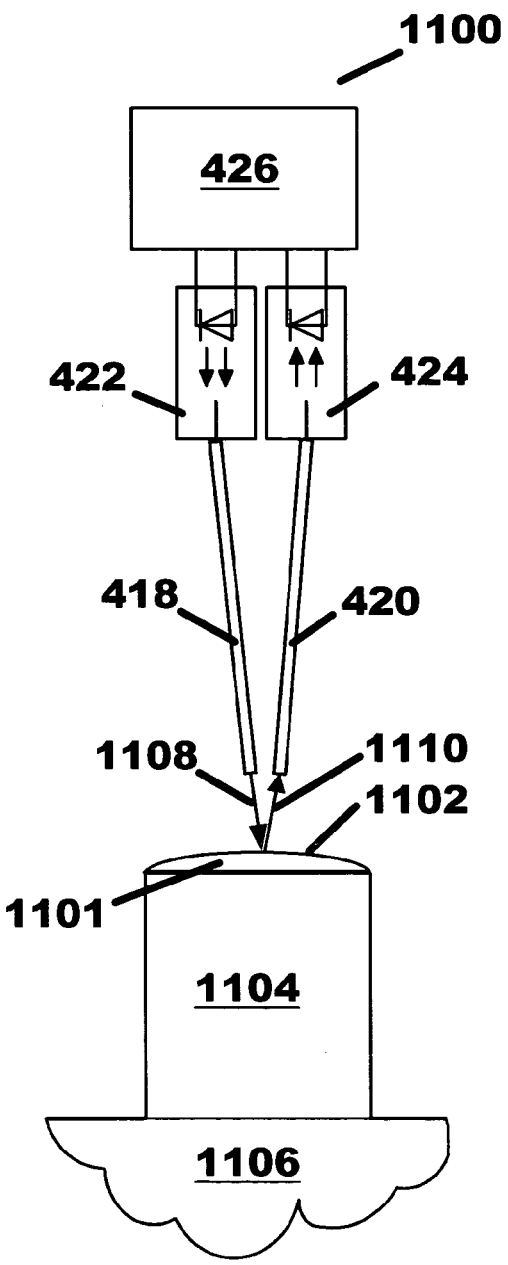
FIG. 11 is a schematic view of a diaphragm actuated optical pressure switch in the low pressure state, according to an embodiment of the present invention; and, FIG. 12 is a schematic view of a diaphragm actuated optical pressure switch in the high pressure state, according to an embodiment of the present invention.
Figure 12:
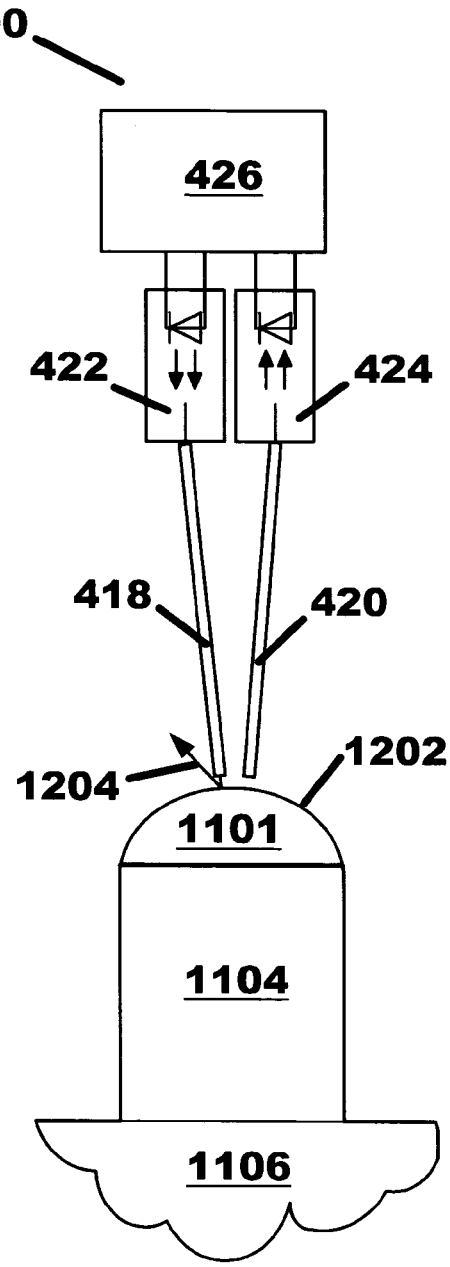

FIG. 11 is a schematic view 1100 of a diaphragm actuated optical pressure switch in the low pressure state, according to an embodiment of the present invention. FIG. 12 is a schematic view 1200 of a diaphragm actuated optical pressure switch in the high pressure state, according to an embodiment of the present invention. A low cost alternative embodiment for detecting high pressures within the interrupter can be obtained through use of a diaphragm 1101. Diaphragm 1101 is fixed to structure 1104, which is generally hollow and tubular in shape. Structure 1104 is in turn fastened to a portion of interrupter segment 1106. Alternatively, diaphragm 1101 could be attached directly to a an outer surface of the interrupter, if convenient. Due to the fragile nature of the thin dome material, structure 1104 acts as a weld or braze interface to the thicker metal structure of the interrupter. Possibly, structure 1104 could be brazed to a port in the insulator section (for example, ref 106 in prior figures) as well. At low pressures inside the interrupter, dome 1101 would reside in the collapsed position, as shown in FIG. 11. At high pressure, dome 1101 would be in the extended position of FIG. 12. The pressures at which the dome transitions from the collapsed position to the extended position would be within the range of 2 to 14.7 psia, preferably between 2 and 7 psia. The dome position is detected by components 418–426. In the low pressure state, the collapsed dome produces a relatively flat surface 1102. A light beam generated by emitter device 422 is transmitted to surface 1102 via optical cable 418. A reflected beam is returned from surface 1102 to optical detector device 424 via optical cable 420. At a high pressure condition, the dome snaps into an approximately hemispherical expanded shape, having significant curvature in its surface 1202. This curvature deflects the light beam emitted from the end of optical cable 418 away from the receiving end of cable 420, causing a loss of signal at detector 424, and generating an alarm condition within the circuitry of device 426. It is also be possible to reverse the logic by using optical cables 418 and 420 to detect the near proximity of the dome in its extended position, creating a loss of signal when its pulled down into an approximately flat position. Alternatively, the position of the dome may be detected by a mechanical shaft (not shown) placed in contact with the dome's outer surface, the opposite end of the shaft intercepting and optical beam as is shown in the embodiments of FIGS. 4–7.

What is claimed is:

1. An apparatus for detecting high pressure within an interrupter, comprising:

a gas tight envelope for containing gas pressure within said interrupter, said gas pressure defining a vacuum pressure condition;

a collapsible device, enclosed within said interrupter, having a first surface and a second surface, said first surface fixed relative to said interrupter, said second surface movable relative to said first surface with an increase in said gas pressure within said interrupter;

a shaft, having a first end and a second end, said first end attached to said second surface of said collapsible device;

a means for detecting a position of said second end of said shaft; and electrical contacts located within said gas tight envelope, mounted for relative movement between a first position in which said electrical contacts are positioned closely adjacent, and an second position in which said electrical contacts are spaced apart from each other, with the vacuum pressure condition in the interrupter preventing electrical arcing between said electrical contacts when they are moved between said first and second positions, wherein movement of said shaft is independent of movement of said electrical contacts between said first and second positions.

2. The apparatus as recited in claim 1, wherein said collapsible device comprises a portion of said gas tight envelope, said collapsible device having an exterior surface, an interior surface, and an interior volume; and, said exterior surface is exposed to said gas pressure within said interrupter, said second surface being a portion of said interior surface, said shaft extending through said interior volume through an exterior wall in said interrupter, said second end of said shaft positioned outside said exterior wall.

3. The apparatus as recited in claim 2, wherein a length of said shaft protruding outside said exterior wall of said interrupter increases when said gas pressure within said interrupter increases.

4. The apparatus as recited in claim 2, wherein said means for detecting said second end of said shaft comprises:

an optical transmitting device;

an optical receiving device;

an optical reflecting surface attached to said second end of said shaft, wherein an optical beam transmitted from said transmitting device is reflected by said reflecting surface to said receiving device at said high pressure.

* * * * *